US009695484B2

(12) United States Patent
Shih et al.

(10) Patent No.: US 9,695,484 B2
(45) Date of Patent: Jul. 4, 2017

(54) SUGAR PRODUCTS AND FABRICATION METHOD THEREOF

(71) Applicant: INDUSTRIAL TECHNOLOGY RESEARCH INSTITUTE, Hsinchu (TW)

(72) Inventors: Ruey-Fu Shih, New Taipei (TW); Jia-Yuan Chen, Hsinchu (TW); Hui-Tsung Lin, New Taipei (TW); Hom-Ti Lee, Zhubei (TW); Hou-Peng Wan, Guishan Township (TW); Wei-Chun Hung, New Taipei (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 539 days.

(21) Appl. No.: 14/040,168

(22) Filed: Sep. 27, 2013

(65) Prior Publication Data

US 2014/0090640 A1 Apr. 3, 2014

Related U.S. Application Data

(63) Continuation-in-part of application No. 13/973,072, filed on Aug. 22, 2013, now abandoned.

(60) Provisional application No. 61/707,576, filed on Sep. 28, 2012.

(30) Foreign Application Priority Data

Sep. 23, 2013 (CN) ..... 2013 1 0435004

(51) Int. Cl.
*C13K 1/02* (2006.01)
*C13K 13/00* (2006.01)

(52) U.S. Cl.
CPC ..... *C13K 1/02* (2013.01); *C13K 13/00* (2013.01); *C13K 13/002* (2013.01)

(58) Field of Classification Search
None
See application file for complete search history.

(56) References Cited

U.S. PATENT DOCUMENTS 4,018,620 A 4/1977 Penque
4,452,640 A * 6/1984 Chen ..... C13K 1/02 127/37
4,713,118 A * 12/1987 Barker ..... C13K 1/06 127/36
4,787,939 A 11/1988 Barker et al.
5,100,791 A 3/1992 Spindler et al.
5,411,594 A 5/1995 Brelsford
5,628,830 A 5/1997 Brink
6,007,636 A 12/1999 Lightner
6,022,419 A 2/2000 Torget et al.
6,423,145 B1 * 7/2002 Nguyen ..... C12P 7/08 106/164.5
6,692,578 B2 2/2004 Schmidt et al.
7,666,637 B2 2/2010 Nguyen
8,003,352 B2 8/2011 Foody et al.
8,460,901 B2 * 6/2013 Marzialetti ..... C12P 7/10 127/37
2005/0096464 A1 5/2005 Heikkila et al.
2007/0112187 A1 5/2007 Heikkila et al.
2007/0125369 A1 6/2007 Olson et al.
2007/0148750 A1 6/2007 Hoshino et al.
2008/0102502 A1 5/2008 Foody et al.
2009/0023187 A1 1/2009 Foody et al.
2009/0042259 A1 2/2009 Dale et al.
2009/0170153 A1 7/2009 Stuart
2009/0221042 A1 9/2009 Dale et al.
2010/0069626 A1 3/2010 Kilambi
2010/0126501 A1 5/2010 Takeshima et al.
2010/0163019 A1 7/2010 Chornet et al.
2010/0175690 A1 7/2010 Nagahama et al.
2010/0240112 A1 9/2010 Anttila et al.
2011/0053239 A1 3/2011 Ray et al.
2011/0065159 A1 3/2011 Raines et al.
2011/0071306 A1 * 3/2011 Robinson ..... C07C 43/137 549/488

(Continued)

FOREIGN PATENT DOCUMENTS

CA 1100266 A 5/1981
CA 2 418 441 A1 2/2002

(Continued)

OTHER PUBLICATIONS

China Office Action for Appl. No. 201310032310.7 dated Oct. 23, 2014.

(Continued)

*Primary Examiner* — Melvin C Mayes
*Assistant Examiner* — Stefanie Cohen
(74) *Attorney, Agent, or Firm* — Birch, Stewart, Kolasch & Birch, LLP

(57) ABSTRACT

In an embodiment of the present disclosure, a sugar product and method for fabricating the same is provided. The method includes mixing an acid compound and lithium chloride, magnesium chloride, calcium chloride, zinc chloride or iron chloride or lithium bromide, magnesium bromide, calcium bromide, zinc bromide or iron bromide or heteropoly acid to form a mixing solution, adding a cellulosic biomass to the mixing solution for a dissolution reaction, and adding water to the mixing solution for a hydrolysis reaction to obtain a sugar product. The present disclosure also provides a sugar product fabricated from the method.

41 Claims, No Drawings

(56) References Cited

U.S. PATENT DOCUMENTS

| | | | |
|---|---|---|---|
| 2011/0223643 | A1 | 9/2011 | Sun et al. |
| 2011/0244499 | A1 | 10/2011 | Realff et al. |
| 2011/0287493 | A1 | 11/2011 | Marzialetti et al. |
| 2012/0192860 | A1 | 8/2012 | Dhepe et al. |
| 2013/0252302 | A1 | 9/2013 | Pan et al. |

FOREIGN PATENT DOCUMENTS

| | | | |
|---|---|---|---|
| CN | 101023179 | A | 8/2007 |
| CN | 101514349 | A | 8/2009 |
| CN | 101855368 | A | 10/2010 |
| CN | 102153763 | A | 8/2011 |
| CN | 102174754 | A | 9/2011 |
| CN | 102575301 | A | 7/2012 |
| CN | 102690897 | A | 9/2012 |
| CN | 102766703 | A | 11/2012 |
| CN | 103710471 | A | 4/2014 |
| CZ | 300865 | B6 | 8/2007 |
| EP | 2336193 | A1 | 6/2011 |
| EP | 2336195 | A1 | 6/2011 |
| GB | 311695 | | 12/1929 |
| GB | 323693 | | 1/1930 |
| TW | 201139679 | A1 | 11/2011 |
| WO | WO 87/00205 | A1 | 1/1987 |
| WO | WO 2006/007691 | A1 | 1/2006 |
| WO | WO 2007/111605 | A1 | 10/2007 |
| WO | WO 2009/080737 | A2 | 7/2009 |
| WO | WO 2010/104371 | A1 | 9/2010 |
| WO | WO 2011/097065 | A2 | 8/2011 |
| WO | 2012/042545 | A1 | 4/2012 |

OTHER PUBLICATIONS

China Office Action for Appl. No. 201310435504.8 dated Oct. 24, 2014.

Qi-Liang, T. et al, "Hydrolyzation of carbohydrates in organosolv pulping of bagasse with formic acid," Journal of Fujian Agriculture and Forestry University, Jul. 2008, vol. 37, No. 4, pp. 404-408.

Taiwan Office Action for Appl. No. 102134952 dated Nov. 24, 2014.

Extended European Search Report, dated Feb. 3, 2014, for European Application No. 13186469.6.

Alvira et al., "Pretreatment technologies for an efficient bioethanol production process based on enzymatic hydrolysis: A review", Bioresource Technology, 101 (2010), pp. 4851-4861.

Amarasekara et al., "Hydrolysis and Decomposition of Cellulose in Bronsted Acidic Ionic Liquids Under Mild Conditions", Ind. Eng. Chem. Res. (2009), 48, pp. 10152-10155.

Binder et al., "Fermentable sugars by chemical hydrolysis of biomass", PNAS, vol. 107, No. 10, Mar. 9, 2010, pp. 4516-4521.

Li et al., "Acid in ionic liquid: An efficient system for hydrolysis of lignocellulose", Green Chem., 2008, 10, pp. 177-182.

Mäki-Arvela et al., "Dissolution of lignocellulosic materials and its constituents using ionic liquids—A review", Industrial Crops and Products, 32 (2010), pp. 175-201.

Shafiei et al., "Techno-economical study of ethanol and biogas from spruce wood by NMMO-pretreatment and rapid fermentation and digestion", Bioresource Technology, 102 (2011), pp. 7879-7886.

Australian Office Action, issued Apr. 20, 2015, for Australian Application No. 2014201106.

Canadian Office Action, issued Apr. 1, 2015, for Canadian Application No. 2,844,556.

* cited by examiner

SUGAR PRODUCTS AND FABRICATION METHOD THEREOF

CROSS REFERENCE TO RELATED APPLICATIONS

This Application claims priority of China Patent Application No. 2013104350048, filed on Sep. 23, 2013. This application is a Continuation-In-Part of application Ser. No. 13/973,072, filed on Aug. 22, 2013, which claims the benefit of provisional Application No. 61/707,576, filed on Sep. 28, 2012, the entireties of which are incorporated by reference herein.

TECHNICAL FIELD

The technical field relates to a sugar product and fabricating method thereof.

BACKGROUND

The world is facing problems such as the gradual extraction and depletion of petroleum reserves, and changes to the earth's atmosphere due to the greenhouse effect. In order to ensure the sustainability of human life, it has become a world trend to gradually decrease the use of petrochemical energy and petroleum feedstock and to develop new sources of renewable energy and materials.

Lignocellulose is the main ingredient of biomass, which is the most abundant organic substance in the world. Lignocellulose mainly consists of 38-50% cellulose, 23-32% hemicellulose and 15-25% lignin. Cellulose generates glucose through hydrolysis. However, it is difficult for chemicals to enter the interior of cellulose molecules for depolymerization due to strong intermolecular and intramolecular hydrogen bonding and Van de Waal forces and the complex aggregate structure of cellulose with high-degree crystallinity. The main methods of hydrolyzing cellulose are enzyme hydrolysis and acid hydrolysis. However, there is significant imperfection in these two technologies, therefore, it is difficult to apply widely.

Generally speaking, enzyme hydrolysis can be carried out at room temperature, which is an environmentally friendly method due to the rarity of byproducts, no production of anti-sugar fermentation substances, and integration with the fermentation process. However, a complicated pretreatment process is required, hydrolytic activity is low, the reaction rate is slow, and cellulose hydrolysis enzyme is expensive.

Dilute acid hydrolysis generally uses comparatively cheap sulfuric acid as a catalyst, but it must operate in a corrosion-resistant pressure vessel at more than 200° C., requiring high-level equipment; simultaneously, the temperature of the dilute acid hydrolysis is high, the byproduct thereof is plentiful, and the sugar yield is low. Concentrated acid hydrolysis can operate at lower temperature and normal pressure. However, there are problems of strong corrosivity of concentrated acid, complications in the post-treatment process of the hydrolyzed solution, large consumption of acid, and difficulties with recycling, among other drawbacks.

SUMMARY

One embodiment of the disclosure provides a sugar product, comprising: a sugar mixture comprising glucose, xylose, mannose, arabinose and oligosaccharides thereof with a weight ratio of 2-15 wt %; an acid compound with a weight ratio of 48-97 wt %; and a salt compound with a weight ratio of 1-50 wt %.

One embodiment of the disclosure provides a method for fabricating a sugar product, comprising: mixing formic acid or acetic acid and lithium chloride, magnesium chloride, calcium chloride, zinc chloride, iron chloride, lithium bromide, magnesium bromide, calcium bromide, zinc bromide, iron bromide, or heteropoly acid to form a mixing solution; adding a cellulosic biomass to the mixing solution for a dissolution reaction; and adding water to the mixing solution for a hydrolysis reaction to obtain a sugar product.

A detailed description is given in the following embodiments.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In one embodiment of the disclosure, a sugar product is provided. The sugar product comprises a sugar mixture, an acid compound, and a salt compound. The sugar mixture comprises glucose, xylose, mannose, arabinose and oligosaccharides thereof with a weight ratio of about 2-15 wt % in the sugar product. The acid compound may comprise formic acid or acetic acid with a weight ratio of about 48-97 wt % in the sugar product. The salt compound may comprise lithium chloride, magnesium chloride, calcium chloride, zinc chloride, iron chloride, lithium bromide, magnesium bromide, calcium bromide, zinc bromide, or iron bromide with a weight ratio of about 1-50 wt % in the sugar product.

In one embodiment of the disclosure, a method for fabricating a sugar product is provided, comprising the following steps. First, formic acid or acetic acid and lithium chloride, magnesium chloride, calcium chloride, zinc chloride, iron chloride, lithium bromide, magnesium bromide, calcium bromide, zinc bromide, iron bromide, or heteropoly acid are mixed to form a mixing solution. A cellulosic biomass is added to the mixing solution for a dissolution reaction. Water is added to the mixing solution for a hydrolysis reaction to obtain a sugar product.

The formic acid has a weight ratio of about 50-97 wt % in the mixing solution.

The lithium chloride or lithium bromide has a weight ratio of about 5-20 wt % or 10-20 wt % in the mixing solution.

The magnesium chloride or magnesium bromide has a weight ratio of about 10-30 wt % or 15-20 wt % in the mixing solution.

The calcium chloride or calcium bromide has a weight ratio of about 12-40 wt % or 12-30 wt % in the mixing solution.

The zinc chloride or zinc bromide has a weight ratio of about 5-45 wt % or 20-30 wt % in the mixing solution.

The iron chloride or iron bromide has a weight ratio of about 1-50 wt % or 5-10 wt % in the mixing solution.

The heteropoly acid may comprise $H_3PW_{12}O_{40}$, $H_4SiW_{12}O_{40}$, $H_3PMo_{12}O_{40}$ or $H_4SiMo_{12}O_{40}$ with a weight ratio of about 1-5 wt % or 2-5 wt % in the mixing solution.

The cellulosic biomass may be derived from wood, grass, leaves, algae, waste paper, corn stalks, corn cobs, rice straw, rice husk, wheat straw, bagasse, bamboo, or crop stems. The cellulosic biomass may comprise cellulose, hemicellulose, or lignin with a weight ratio of about 1-20 wt % or 5-15 wt % in the mixing solution.

The dissolution reaction has a reaction temperature of about 40-90° C. or 50-70° C. and a reaction time of about 20-360 minutes or 30-120 minutes.

In the hydrolysis reaction, the amount of water added is larger than the total molar equivalent of monosaccharides hydrolyzed from the cellulosic biomass.

The hydrolysis reaction has a reaction temperature of about 50-150° C. or 60-105° C. and a reaction time of about 30-180 minutes or 30-120 minutes.

The sugar product fabricated by the method may comprise a sugar mixture, an acid compound, and a salt compound. The sugar mixture may comprise glucose, xylose, mannose, arabinose and oligosaccharides thereof with a weight ratio of about 2-15 wt % in the sugar product. The acid compound may comprise formic acid or acetic acid with a weight ratio of about 48-97 wt % in the sugar product. The salt compound may comprise lithium chloride, magnesium chloride, calcium chloride, zinc chloride, iron chloride, lithium bromide, magnesium bromide, calcium bromide, zinc bromide, or iron bromide with a weight ratio of about 1-50 wt % in the sugar product.

In one embodiment, the method further comprises adding inorganic acid to the mixing solution before, during or after the dissolution reaction. The inorganic acid may comprise sulfuric acid or hydrochloric acid. The inorganic acid has a weight ratio of about 1-2 wt % in the mixing solution. When the inorganic acid is added, the adding amount of the chloride salt or the bromide salt may be reduced, for example, the weight ratio of the magnesium chloride, the magnesium bromide, the calcium chloride or the calcium bromide in the mixing solution may be reduced to about 1-10 wt %, and the weight ratio of the lithium chloride, the lithium bromide, the zinc chloride, the zinc bromide, the iron chloride or the iron bromide in the mixing solution may be reduced to about 1-5 wt %.

In the disclosure, formic acid or acetic acid (weak acid) is mixed with lithium chloride, magnesium chloride, calcium chloride, zinc chloride, iron chloride, lithium bromide, magnesium bromide, calcium bromide, zinc bromide, or iron bromide to be utilized as a solvent with the characteristic of dissolving cellulose under low temperature (<90° C.) and rapid reaction time (<6 hours) to generate a homogeneous liquid. In the disclosed method, cellulose is dissolved in the solvent formed by chloride salt or bromide salt and formic acid or acetic acid to generate a homogeneous liquid at 40-150° C., and a sugar product is further obtained through hydrolysis. This method achieves the technical goals of low temperature, normal pressure, rapid reaction time and high sugar yield and without use of a strong acid corrosion-resistant reactor.

EXAMPLES

Example 1-1

Formic acid and zinc chloride ($ZnCl_2$) were mixed and heated to form a mixing solution (60 wt % of formic acid, 40 wt % of zinc chloride). Avicel® cellulose (Sigma Corporation, Avicel-pH-105-27NI) was added to the mixing solution (15 wt % of Avicel® cellulose) for a dissolution reaction (50° C., 20 minutes) to form a yellow, homogeneous, and transparent liquid, as recorded in Table 1.

Example 1-2

Formic acid and zinc chloride ($ZnCl_2$) were mixed and heated to form a mixing solution (60 wt % of formic acid, 40 wt % of zinc chloride). α-cellulose (Sigma Corporation, C8002) was added to the mixing solution (15 wt % of α-cellulose) for a dissolution reaction (50° C., 20 minutes) to form an amber, homogeneous, and transparent liquid, as recorded in Table 1.

Example 1-3

Formic acid and calcium chloride ($CaCl_2$) were mixed and heated to form a mixing solution (75 wt % of formic acid, 25 wt % of calcium chloride). Avicel® cellulose (Sigma Corporation, Avicel-pH-105-27NI) was added to the mixing solution (6 wt % of Avicel® cellulose) for a dissolution reaction (65° C., 90 minutes) to form a yellow, homogeneous, and transparent liquid, as recorded in Table 1.

Example 1-4

Formic acid and calcium chloride ($CaCl_2$) were mixed and heated to form a mixing solution (75 wt % of formic acid, 25 wt % of calcium chloride). α-cellulose (Sigma Corporation, C8002) was added to the mixing solution (6 wt % of α-cellulose) for a dissolution reaction (65° C., 90 minutes) to form an amber, homogeneous, and transparent liquid, as recorded in Table 1.

Example 1-5

Formic acid and magnesium chloride ($MgCl_2$) were mixed and heated to form a mixing solution (80 wt % of formic acid, 20 wt % of magnesium chloride). Avicel® cellulose (Sigma Corporation, Avicel-pH-105-27NI) was added to the mixing solution (5 wt % of Avicel® cellulose) for a dissolution reaction (65° C., 120 minutes) to form an amber, homogeneous, and transparent liquid, as recorded in Table 1.

Example 1-6

Formic acid and magnesium chloride ($MgCl_2$) were mixed and heated to form a mixing solution (80 wt % of formic acid, 20 wt % of magnesium chloride). α-cellulose (Sigma Corporation, C8002) was added to the mixing solution (5 wt % of α-cellulose) for a dissolution reaction (65° C., 120 minutes) to form an amber, homogeneous, and transparent liquid, as recorded in Table 1.

TABLE 1

| Examples | Salt (wt %) | Cellulose (wt %) | Dissolution temp. (° C.) | Dissolution time (min) | Solution appearance |
|---|---|---|---|---|---|
| 1-1 | zinc chloride (40) | Avicel ® cellulose (15) | 50 | 20 | yellow, homogeneous and transparent liquid |
| 1-2 | zinc chloride (40) | α-cellulose (15) | 50 | 20 | amber, homogeneous and transparent liquid |
| 1-3 | calcium chloride (25) | Avicel ® cellulose (6) | 65 | 90 | yellow, homogeneous and transparent liquid |
| 1-4 | calcium chloride (25) | α-cellulose (6) | 65 | 90 | amber, homogeneous and transparent liquid |
| 1-5 | magnesium chloride (20) | Avicel ® cellulose (5) | 65 | 120 | amber, homogeneous and transparent liquid |
| 1-6 | magnesium chloride (20) | α-cellulose (5) | 65 | 120 | amber, homogeneous and transparent liquid |

Example 2-1

Formic acid and lithium chloride (LiCl) were mixed and heated to form a mixing solution (90 wt % of formic acid, 10 wt % of lithium chloride). Avicel® cellulose (Sigma Corporation, Avicel-pH-105-27NI) was added to the mixing solution (5 wt % of Avicel® cellulose) for a dissolution reaction (70° C., 6 hours). The dissolution of cellulose was observed using a polarizing microscope, as recorded in Table 2.

Example 2-2

Formic acid and lithium chloride (LiCl) were mixed and heated to form a mixing solution (95 wt % of formic acid, 5 wt % of lithium chloride). Avicel® cellulose (Sigma Corporation, Avicel-pH-105-27NI) was added to the mixing solution (5 wt % of Avicel® cellulose) for a dissolution reaction (70° C., 12 hours). The dissolution of cellulose was observed using a polarizing microscope, as recorded in Table 2.

Example 2-3

Formic acid and sodium chloride (NaCl) were mixed and heated to form a mixing solution (90 wt % of formic acid, 10 wt % of sodium chloride (saturated solution)). Avicel® cellulose (Sigma Corporation, Avicel-pH-105-27NI) was added to the mixing solution (5 wt % of Avicel® cellulose) for a dissolution reaction (70° C., 19 hours). The dissolution of cellulose was observed using a polarizing microscope, as recorded in Table 2.

Example 2-4

Formic acid and lithium bromide (LiBr) were mixed and heated to form a mixing solution (90 wt % of formic acid, 10 wt % of lithium bromide). Avicel® cellulose (Sigma Corporation, Avicel-pH-105-27NI) was added to the mixing solution (5 wt % of Avicel® cellulose) for a dissolution reaction (70° C., 0.5 hour). The dissolution of cellulose was observed using a polarizing microscope, as recorded in Table 2.

Example 2-5

Formic acid and sodium bromide (NaBr) were mixed and heated to form a mixing solution (82 wt % of formic acid, 18 wt % of sodium bromide). Avicel® cellulose (Sigma Corporation, Avicel-pH-105-27NI) was added to the mixing solution (5 wt % of Avicel® cellulose) for a dissolution reaction (70° C., 9 hours). The dissolution of cellulose was observed using a polarizing microscope, as recorded in Table 2.

Example 2-6

Formic acid and calcium bromide ($CaBr_2$) were mixed and heated to form a mixing solution (88 wt % of formic acid, 12 wt % of calcium bromide). Avicel® cellulose (Sigma Corporation, Avicel-pH-105-27NI) was added to the mixing solution (5 wt % of Avicel® cellulose) for a dissolution reaction (70° C., 6 hours). The dissolution of cellulose was observed using a polarizing microscope, as recorded in Table 2.

Example 2-7

Formic acid and barium bromide ($BaBr_2$) were mixed and heated to form a mixing solution (80 wt % of formic acid, 20 wt % of barium bromide). Avicel® cellulose (Sigma Corporation, Avicel-pH-105-27NI) was added to the mixing solution (5 wt % of Avicel® cellulose) for a dissolution reaction (70° C., 6 hours). The dissolution of cellulose was observed using a polarizing microscope, as recorded in Table 2.

Example 2-8

Formic acid and magnesium chloride ($MgCl_2$) were mixed and heated to form a mixing solution (80 wt % of formic acid, 20 wt % of magnesium chloride (saturated solution)). Avicel® cellulose (Sigma Corporation, Avicel-pH-105-27NI) was added to the mixing solution (5 wt % of Avicel® cellulose) for a dissolution reaction (65° C., 2 hours). The dissolution of cellulose was observed using a polarizing microscope, as recorded in Table 2.

Example 2-9

Formic acid and magnesium chloride ($MgCl_2$) were mixed and heated to form a mixing solution (90 wt % of formic acid, 10 wt % of magnesium chloride). Avicel® cellulose (Sigma Corporation, Avicel-pH-105-27NI) was added to the mixing solution (5 wt % of Avicel® cellulose) for a dissolution reaction (70° C., 12 hours). The dissolution of cellulose was observed using a polarizing microscope, as recorded in Table 2.

Example 2-10

Formic acid and calcium chloride ($CaCl_2$) were mixed and heated to form a mixing solution (75 wt % of formic acid, 25 wt % of calcium chloride (saturated solution)). Avicel® cellulose (Sigma Corporation, Avicel-pH-105-27NI) was added to the mixing solution (5 wt % of Avicel® cellulose) for a dissolution reaction (65° C., 1.5 hours). The dissolution of cellulose was observed using a polarizing microscope, as recorded in Table 2.

Example 2-11

Formic acid and calcium chloride ($CaCl_2$) were mixed and heated to form a mixing solution (82.5 wt % of formic acid, 17.5 wt % of calcium chloride). Avicel® cellulose (Sigma Corporation, Avicel-pH-105-27NI) was added to the mixing solution (5 wt % of Avicel® cellulose) for a dissolution reaction (70° C., 2 hours). The dissolution of cellulose was observed using a polarizing microscope, as recorded in Table 2.

Example 2-12

Formic acid and calcium chloride ($CaCl_2$) were mixed and heated to form a mixing solution (88 wt % of formic acid, 12 wt % of calcium chloride). Avicel® cellulose (Sigma Corporation, Avicel-pH-105-27NI) was added to the mixing solution (5 wt % of Avicel® cellulose) for a dissolution reaction (70° C., 6 hours). The dissolution of cellulose was observed using a polarizing microscope, as recorded in Table 2.

Example 2-13

Formic acid and calcium chloride ($CaCl_2$) were mixed and heated to form a mixing solution (90 wt % of formic acid, 10 wt % of calcium chloride). Avicel® cellulose (Sigma Corporation, Avicel-pH-105-27NI) was added to the mixing solution (5 wt % of Avicel® cellulose) for a dissolution reaction (70° C., 12 hours). The dissolution of cellulose was observed using a polarizing microscope, as recorded in Table 2.

Example 2-14

Formic acid and barium chloride ($BaCl_2$) were mixed and heated to form a mixing solution (85 wt % of formic acid, 15 wt % of barium chloride (saturated solution)). Avicel® cellulose (Sigma Corporation, Avicel-pH-105-27NI) was added to the mixing solution (5 wt % of Avicel® cellulose) for a dissolution reaction (70° C., >6 hours). The dissolution of cellulose was observed using a polarizing microscope, as recorded in Table 2.

Example 2-15

Formic acid and zinc chloride ($ZnCl_2$) were mixed and heated to form a mixing solution (60 wt % of formic acid, 40 wt % of zinc chloride). Avicel® cellulose (Sigma Corporation, Avicel-pH-105-27NI) was added to the mixing solution (5 wt % of Avicel® cellulose) for a dissolution reaction (50° C., 0.25 hour). The dissolution of cellulose was observed using a polarizing microscope, as recorded in Table 2.

Example 2-16

Formic acid and zinc chloride ($ZnCl_2$) were mixed and heated to form a mixing solution (80 wt % of formic acid, 20 wt % of zinc chloride). Avicel® cellulose (Sigma Corporation, Avicel-pH-105-27NI) was added to the mixing solution (5 wt % of Avicel® cellulose) for a dissolution reaction (65° C., 0.25 hour). The dissolution of cellulose was observed using a polarizing microscope, as recorded in Table 2.

Example 2-17

Formic acid and zinc chloride ($ZnCl_2$) were mixed and heated to form a mixing solution (95 wt % of formic acid, 5 wt % of zinc chloride). Avicel® cellulose (Sigma Corporation, Avicel-pH-105-27NI) was added to the mixing solution (5 wt % of Avicel® cellulose) for a dissolution reaction (70° C., 6 hours). The dissolution of cellulose was observed using a polarizing microscope, as recorded in Table 2.

Example 2-18

Formic acid and zinc chloride ($ZnCl_2$) were mixed and heated to form a mixing solution (98 wt % of formic acid, 2 wt % of zinc chloride). Avicel® cellulose (Sigma Corporation, Avicel-pH-105-27NI) was added to the mixing solution (5 wt % of Avicel® cellulose) for a dissolution reaction (70° C., >6 hours). The dissolution of cellulose was observed using a polarizing microscope, as recorded in Table 2.

Example 2-19

Formic acid and iron chloride ($FeCl_3$) were mixed and heated to form a mixing solution (95 wt % of formic acid, 5 wt % of iron chloride). Avicel® cellulose (Sigma Corporation, Avicel-pH-105-27NI) was added to the mixing solution (5 wt % of Avicel® cellulose) for a dissolution reaction (70° C., 1 hour). The dissolution of cellulose was observed using a polarizing microscope, as recorded in Table 2.

Example 2-20

Formic acid and iron chloride ($FeCl_3$) were mixed and heated to form a mixing solution (98 wt % of formic acid, 2 wt % of iron chloride). Avicel® cellulose (Sigma Corporation, Avicel-pH-105-27NI) was added to the mixing solution (5 wt % of Avicel® cellulose) for a dissolution reaction (70° C., 3 hours). The dissolution of cellulose was observed using a polarizing microscope, as recorded in Table 2.

Example 2-21

Formic acid and iron chloride ($FeCl_3$) were mixed and heated to form a mixing solution (99 wt % of formic acid, 1 wt % of iron chloride). Avicel® cellulose (Sigma Corporation, Avicel-pH-105-27NI) was added to the mixing solution (5 wt % of Avicel® cellulose) for a dissolution reaction (70° C., 6 hours). The dissolution of cellulose was observed using a polarizing microscope, as recorded in Table 2.

Example 2-22

Formic acid and ammonium chloride ($NH_4Cl$) were mixed and heated to form a mixing solution (90 wt % of formic acid, 10 wt % of ammonium chloride (saturated solution)). Avicel® cellulose (Sigma Corporation, Avicel-pH-105-27NI) was added to the mixing solution (5 wt % of Avicel® cellulose) for a dissolution reaction (70° C., >12 hours). The dissolution of cellulose was observed using a polarizing microscope, as recorded in Table 2.

Example 2-23

Formic acid and aluminum chloride ($AlCl_3$) were mixed and heated to form a mixing solution (98 wt % of formic acid, 2 wt % of aluminum chloride (saturated solution)). Avicel® cellulose (Sigma Corporation, Avicel-pH-105-27NI) was added to the mixing solution (5 wt % of Avicel® cellulose) for a dissolution reaction (70° C., 6 hours). The dissolution of cellulose was observed using a polarizing microscope, as recorded in Table 2.

Example 2-24

Formic acid and tin chloride ($SnCl_3$) were mixed and heated to form a mixing solution (95 wt % of formic acid, 5 wt % of tin chloride (saturated solution)). Avicel® cellulose (Sigma Corporation, Avicel-pH-105-27NI) was added to the mixing solution (5 wt % of Avicel® cellulose) for a dissolution reaction (70° C., 6 hours). The dissolution of cellulose was observed using a polarizing microscope, as recorded in Table 2.

Example 2-25

Formic acid and calcium sulfate ($CaSO_4$) were mixed and heated to form a mixing solution (80 wt % of formic acid, 20 wt % of calcium sulfate). Avicel® cellulose (Sigma Corporation, Avicel-pH-105-27NI) was added to the mixing solution (5 wt % of Avicel® cellulose) for a dissolution reaction (70° C., 6 hours). The dissolution of cellulose was observed using a polarizing microscope, as recorded in Table 2.

Example 2-26

Formic acid and heteropoly acid ($H_3PW_{12}O_{40}$) were mixed and heated to form a mixing solution (99 wt % of formic acid, 1 wt % of heteropoly acid). Avicel® cellulose (Sigma Corporation, Avicel-pH-105-27NI) was added to the mixing solution (5 wt % of Avicel® cellulose) for a dissolution reaction (70° C., 6 hours). The dissolution of cellulose was observed using a polarizing microscope, as recorded in Table 2.

TABLE 2

| Examples | Salt | wt % | Dissolution temp. (° C.) | Dissolution time (hour) | Dissolution of cellulose |
|---|---|---|---|---|---|
| 2-1 | lithium chloride | 10 | 70 | 6 | complete dissolution |
| 2-2 | | 5 | 70 | 12 | no dissolution |
| 2-3 | sodium chloride | 10, saturated | 70 | 19 | no dissolution |
| 2-4 | lithium bromide | 10 | 70 | 0.5 | complete dissolution |
| 2-5 | sodium bromide | 18 | 70 | 9 | no dissolution |
| 2-6 | calcium bromide | 12 | 70 | 6 | complete dissolution |
| 2-7 | barium bromide | 20 | 70 | 6 | no dissolution |
| 2-8 | magnesium chloride | 20, saturated | 65 | 2 | complete dissolution |
| 2-9 | | 10 | 70 | 12 | no dissolution |
| 2-10 | calcium chloride | 25, saturated | 65 | 1.5 | complete dissolution |
| 2-11 | | 17.5 | 70 | 2 | complete dissolution |
| 2-12 | | 12 | 70 | 6 | complete dissolution |
| 2-13 | | 10 | 70 | 12 | no dissolution |
| 2-14 | barium chloride | 15, saturated | 70 | >6 | no dissolution |

TABLE 2-continued

| Examples | Salt | wt % | Dissolution temp. (° C.) | Dissolution time (hour) | Dissolution of cellulose |
|---|---|---|---|---|---|
| 2-15 | zinc chloride | 40 | 50 | 0.25 | complete dissolution |
| 2-16 | | 20 | 65 | 0.25 | complete dissolution |
| 2-17 | | 5 | 70 | 6 | complete dissolution |
| 2-18 | | 2 | 70 | >6 | no dissolution |
| 2-19 | iron chloride | 5 | 70 | 1 | complete dissolution |
| 2-20 | | 2 | 70 | 3 | complete dissolution |
| 2-21 | | 1 | 70 | 6 | complete dissolution |
| 2-22 | ammonium chloride | 10, saturated | 70 | >12 | no dissolution |
| 2-23 | aluminum chloride | 2, saturated | 70 | 6 | no dissolution |
| 2-24 | tin chloride | 5, saturated | 70 | 6 | no dissolution |
| 2-25 | calcium sulfate | 20 | 70 | 6 | no dissolution |
| 2-26 | heteropoly acid ($H_3PW_{12}O_{40}$) | 1 | 70 | 6 | complete dissolution |

Example 3-1

Formic acid and magnesium chloride ($MgCl_2$) were mixed by stirring and heated to 70° C. under 1 atm to form a mixing solution (80 wt % of formic acid, 20 wt % of magnesium chloride). Avicel® cellulose (Sigma Corporation, Avicel-pH-105-27NI) was added to the mixing solution (5 wt % of Avicel® cellulose) for a dissolution reaction (70° C., 2 hours). After the complete dissolution of the cellulose, water was added to the mixing solution (50 wt % of water) and the mixing solution was heated to 100° C. for a hydrolysis reaction (120 minutes). Next, saturated sodium carbonate ($Na_2CO_3$) aqueous solution was added to neutralize the mixing solution. Magnesium carbonate ($MgCO_3$) precipitate was then removed from the mixing solution. Next, the total weight of the reducing sugar was measured using 3,5-dinitro-salicylic acid (DNS) method. The yield of the reducing sugar was then calculated. The reducing sugar comprised glucose, xylose, mannose, arabinose and oligosaccharides thereof. The yield of the reducing sugar is the ratio of the total weight of the reducing sugar and the weight of the cellulose. The result is shown in Table 3.

Example 3-2

Formic acid and magnesium chloride ($MgCl_2$) were mixed by stirring and heated to 70° C. under 1 atm to form a mixing solution (90 wt % of formic acid, 10 wt % of magnesium chloride). Avicel® cellulose (Sigma Corporation, Avicel-pH-105-27NI) was added to the mixing solution (5 wt % of Avicel® cellulose) for a dissolution reaction (70° C., 6 hours). After the complete dissolution of the cellulose, water was added to the mixing solution (50 wt % of water) and the mixing solution was heated to 100° C. for a hydrolysis reaction (120 minutes). Next, saturated sodium carbonate ($Na_2CO_3$) aqueous solution was added to neutralize the mixing solution. Magnesium carbonate ($MgCO_3$) precipitate was then removed from the mixing solution. Next, the total weight of the reducing sugar was measured using 3,5-dinitro-salicylic acid (DNS) method. The yield of the reducing sugar was then calculated. The reducing sugar comprised glucose, xylose, mannose, arabinose and oligosaccharides thereof. The yield of the reducing sugar is the ratio of the total weight of the reducing sugar and the weight of the cellulose. The result is shown in Table 3.

TABLE 3

| Examples | Cellulose (wt %) | Mixing solution (magnesium chloride:formic acid) (wt %) | Dissolution temp. (° C.) | Dissolution time (hour) | Hydrolysis temp. (° C.) | Hydrolysis time (min) | Yield of reducing sugar (%) |
|---|---|---|---|---|---|---|---|
| 3-1 | 5 | 20:80 | 70 | 2 | 100 | 120 | 97.9 |
| 3-2 | 5 | 10:90 | 70 | 6 | 100 | 120 | 75.3 |

Example 4-1

Formic acid and calcium chloride ($CaCl_2$) were mixed by stirring and heated to 50° C. under 1 atm to form a mixing solution (85 wt % of formic acid, 15 wt % of calcium chloride). Avicel® cellulose (Sigma Corporation, Avicel-pH-105-27NI) was added to the mixing solution (5 wt % of Avicel® cellulose) for a dissolution reaction (50° C., 4 hours). After the complete dissolution of the cellulose, water was added to the mixing solution (50 wt % of water) and the mixing solution was heated to 100° C. for a hydrolysis reaction (60 minutes). Next, saturated sodium carbonate ($Na_2CO_3$) aqueous solution was added to neutralize the mixing solution. Calcium carbonate ($CaCO_3$) precipitate was then removed from the mixing solution. Next, the total weight of the reducing sugar was measured using 3,5-dinitro-salicylic acid (DNS) method. The yield of the reducing sugar was then calculated. The reducing sugar comprised glucose, xylose, mannose, arabinose and oligosaccharides thereof. The yield of the reducing sugar is the ratio of the total weight of the reducing sugar and the weight of the cellulose. The result is shown in Table 4.

Example 4-2

Formic acid and calcium chloride ($CaCl_2$) were mixed by stirring and heated to 70° C. under 1 atm to form a mixing solution (88 wt % of formic acid, 12 wt % of calcium chloride). Avicel® cellulose (Sigma Corporation, Avicel-pH-105-27NI) was added to the mixing solution (5 wt % of Avicel® cellulose) for a dissolution reaction (70° C., 4 hours). After the complete dissolution of the cellulose, water was added to the mixing solution (50 wt % of water) and the mixing solution was heated to 100° C. for a hydrolysis reaction (60 minutes). Next, saturated sodium carbonate ($Na_2CO_3$) aqueous solution was added to neutralize the mixing solution. Calcium carbonate ($CaCO_3$) precipitate was then removed from the mixing solution. Next, the total weight of the reducing sugar was measured using 3,5-dinitro-salicylic acid (DNS) method. The yield of the reducing sugar was then calculated. The reducing sugar comprised glucose, xylose, mannose, arabinose and oligosaccharides thereof. The yield of the reducing sugar is the ratio of the total weight of the reducing sugar and the weight of the cellulose. The result is shown in Table 4.

Example 4-3

Formic acid and calcium chloride ($CaCl_2$) were mixed by stirring and heated to 90° C. under 1 atm to form a mixing solution (90 wt % of formic acid, 10 wt % of calcium chloride). Avicel® cellulose (Sigma Corporation, Avicel-pH-105-27NI) was added to the mixing solution (5 wt % of Avicel® cellulose) for a dissolution reaction (90° C., 4 hours). After the complete dissolution of the cellulose, water was added to the mixing solution (50 wt % of water) and the mixing solution was heated to 100° C. for a hydrolysis reaction (60 minutes). Next, saturated sodium carbonate ($Na_2CO_3$) aqueous solution was added to neutralize the mixing solution. Calcium carbonate ($CaCO_3$) precipitate was then removed from the mixing solution. Next, the total weight of the reducing sugar was measured using 3,5-dinitro-salicylic acid (DNS) method. The yield of the reducing sugar was then calculated. The reducing sugar comprised glucose, xylose, mannose, arabinose and oligosaccharides thereof. The yield of the reducing sugar is the ratio of the total weight of the reducing sugar and the weight of the cellulose. The result is shown in Table 4.

TABLE 4

| Examples | Cellulose (wt %) | Mixing solution (calcium chloride:formic acid) (wt %) | Dissolution temp. (° C.) | Dissolution time (hour) | Hydrolysis temp. (° C.) | Hydrolysis time (min) | Yield of reducing sugar (%) |
|---|---|---|---|---|---|---|---|
| 4-1 | 5 | 15:85 | 50 | 4 | 100 | 60 | 78.4 |
| 4-2 | 5 | 12:88 | 70 | 4 | 100 | 60 | 70.6 |
| 4-3 | 5 | 10:90 | 90 | 4 | 100 | 60 | 67.3 |

Example 5-1

Formic acid and zinc chloride ($ZnCl_2$) were mixed by stirring and heated to 50° C. under 1 atm to form a mixing solution (60 wt % of formic acid, 40 wt % of zinc chloride). Avicel® cellulose (Sigma Corporation, Avicel-pH-105-27NI) was added to the mixing solution (5 wt % of Avicel® cellulose) for a dissolution reaction (50° C.). After the complete dissolution of the cellulose, water was added to the mixing solution (50 wt % of water) and the mixing solution was heated to 100° C. for a hydrolysis reaction (30 minutes). Next, saturated sodium carbonate ($Na_2CO_3$) aqueous solution was added to neutralize the mixing solution. Zinc carbonate ($ZnCO_3$) precipitate was then removed from the mixing solution. Next, the total weight of the reducing sugar was measured using 3,5-dinitro-salicylic acid (DNS) method. The yield of the reducing sugar was then calculated. The reducing sugar comprised glucose, xylose, mannose, arabinose and oligosaccharides thereof. The yield of the reducing sugar is the ratio of the total weight of the reducing sugar and the weight of the cellulose. The result is shown in Table 5.

Example 5-2

Formic acid and zinc chloride ($ZnCl_2$) were mixed by stirring and heated to 50° C. under 1 atm to form a mixing solution (60 wt % of formic acid, 40 wt % of zinc chloride). Avicel® cellulose (Sigma Corporation, Avicel-pH-105-27NI) was added to the mixing solution (5 wt % of Avicel® cellulose) for a dissolution reaction (50° C.). After the complete dissolution of the cellulose, water was added to the mixing solution (50 wt % of water) and the mixing solution was heated to 100° C. for a hydrolysis reaction (45 minutes). Next, saturated sodium carbonate ($Na_2CO_3$) aqueous solution was added to neutralize the mixing solution. Zinc carbonate ($ZnCO_3$) precipitate was then removed from the mixing solution. Next, the total weight of the reducing sugar was measured using 3,5-dinitro-salicylic acid (DNS) method. The yield of the reducing sugar was then calculated. The reducing sugar comprised glucose, xylose, mannose, arabinose and oligosaccharides thereof. The yield of the reducing sugar is the ratio of the total weight of the reducing sugar and the weight of the cellulose. The result is shown in Table 5.

TABLE 5

| Examples | Cellulose (wt %) | Adding amount of water (wt %) | Hydrolysis time (min) | Yield of reducing sugar (%) |
|---|---|---|---|---|
| 5-1 | 5 | 50 | 30 | 65 |
| 5-2 | 5 | 50 | 45 | 89 |

Example 6

Formic acid and zinc chloride ($ZnCl_2$) were mixed by stirring and heated to 55° C. under 1 atm to form a mixing solution (60 wt % of formic acid, 40 wt % of zinc chloride). Dried bagasse (comprising 43.58 wt % of glucan, 24.02 wt % of xylan, 12.45 wt % of acid-soluble lignin, 18.12 wt % of acid-insoluble lignin and 1.71 wt % of ash) was added to the mixing solution (5 wt % of bagasse) for a dissolution reaction (55° C.). After the dissolution of the bagasse, water was added to the mixing solution (50 wt % of water) and the mixing solution was heated to 100° C. for a hydrolysis reaction (120 minutes). Next, saturated sodium carbonate ($Na_2CO_3$) aqueous solution was added to neutralize the mixing solution. Zinc carbonate ($ZnCO_3$) precipitate was then removed from the mixing solution. Next, the yields of glucose and xylose were analyzed using high performance liquid chromatography (HPLC) and the total weight of the reducing sugar was measured using 3,5-dinitro-salicylic acid (DNS) method. The yield of the reducing sugar was then calculated. The reducing sugar comprised glucose, xylose, mannose, arabinose and oligosaccharides thereof. The yield of the glucose is the ratio of the moles of the produced glucose and the moles of the glucose monomers contained in the cellulose in the bagasse. The yield of the xylose is the ratio of the moles of the produced xylose and the moles of the xylose monomers contained in the hemicellulose in the bagasse. The yield of the reducing sugar is the ratio of the total weight of the reducing sugar and the total weight of the cellulose and hemicellulose in the bagasse. The result is shown in Table 6. After the hydrolysis reaction, a hydrolyzed solution comprising 25.3 wt % of zinc chloride, 33.2 wt % of water, 38.2 wt % of formic acid, 2.3 wt % of reducing sugar (comprising 43.2 wt % of glucose and 30.4 wt % of xylose), 0.4 wt % of acid-soluble lignin and 0.6 wt % of acid-insoluble lignin was formed.

TABLE 6

| Examples | Bagasse (wt %) | Amount of water added (wt %) | Hydrolysis time (min) | Yield of glucose (%) | Yield of xylose (%) | Yield of reducing sugar (%) |
|---|---|---|---|---|---|---|
| 6-1 | 5 | 50 | 30 | 36.3 | 88.5 | 93.3 |
| 6-2 | 5 | 50 | 60 | 53.3 | 94.2 | 97.9 |
| 6-3 | 5 | 50 | 120 | 70.4 | 89.9 | 105.2 |

Example 7

Formic acid and magnesium chloride ($MgCl_2$) were mixed by stirring and heated to 50° C. under 1 atm to form a mixing solution (80 wt % of formic acid, 20 wt % of magnesium chloride). Avicel® cellulose (Sigma Corporation, Avicel-pH-105-27NI) was added to the mixing solution (5 wt % of Avicel® cellulose) for a dissolution reaction (50° C., 2.5 hours). After the dissolution of the cellulose, water was added to the mixing solution (50 wt % of water) and the mixing solution was heated to 100° C. for a hydrolysis reaction (90 minutes). Next, saturated sodium carbonate ($Na_2CO_3$) aqueous solution was added to neutralize the mixing solution. Magnesium carbonate ($MgCO_3$) precipitate was then removed from the mixing solution. Next, the total weight of the reducing sugar was measured using 3,5-dinitro-salicylic acid (DNS) method. The yield of the reducing sugar was then calculated. The reducing sugar comprised glucose, xylose, mannose, arabinose and oligosaccharides thereof. The yield of the reducing sugar is the ratio of the total weight of the reducing sugar and the weight of the cellulose. The result is shown in Table 7.

TABLE 7

| Examples | Cellulose (wt %) | Mixing solution (magnesium chloride:formic acid) (wt %) | Dissolution temp. (° C.) | Dissolution time (hour) | Hydrolysis temp. (° C.) | Hydrolysis time (min) | Yield of reducing sugar (%) |
|---|---|---|---|---|---|---|---|
| 7 | 5 | 20:80 | 50 | 2.5 | 100 | 0th | 46 |
| | | | | | 100 | 90th | 89 |

Example 8

Formic acid and zinc chloride ($ZnCl_2$) were mixed by stirring and heated to 55° C. under 1 atm to form a mixing solution (60 wt % of formic acid, 40 wt % of zinc chloride). Dried corn stalks (comprising 44.5 wt % of glucan, 12.4 wt % of xylan, 4.6 wt % of acid-soluble lignin, 24.4 wt % of acid-insoluble lignin, 2.7 wt % of water and 3.8 wt % of ash) was added to the mixing solution (5 wt % of corn stalks) for a dissolution reaction (55° C.). After the dissolution of the corn stalks, water was added to the mixing solution (50 wt % of water) and the mixing solution was heated to 100° C. for a hydrolysis reaction (90 minutes). Next, saturated sodium carbonate ($Na_2CO_3$) aqueous solution was added to neutralize the mixing solution. Zinc carbonate ($ZnCO_3$) precipitate was then removed from the mixing solution. Next, the yields of glucose and xylose were analyzed using high performance liquid chromatography (HPLC) and the total weight of the reducing sugar was measured using 3,5-dinitro-salicylic acid (DNS) method. The yield of the glucose is the ratio of the moles of the produced glucose and the moles of the glucose monomers contained in the cellulose in the corn stalks. The yield of the reducing sugar was then calculated. The reducing sugar comprised glucose, xylose, mannose, arabinose and oligosaccharides thereof. The yield of the reducing sugar is the ratio of the total weight of the reducing sugar and the total weight of the cellulose and hemicellulose in the corn stalks. The result is shown in Table 8.

TABLE 8

| Examples | Corn stalks (wt %) | Amount of water added (wt %) | Hydrolysis time (min) | Yield of glucose (%) | Yield of reducing sugar (%) |
|---|---|---|---|---|---|
| 8 | 5 | 50 | 90 | 85 | 96 |

Example 9-1

37 wt % of HCl, zinc chloride ($ZnCl_2$) and formic acid were mixed by stirring and heated to 55° C. under 1 atm to form a mixing solution (1 wt % of HCl, 5 wt % of zinc chloride, 94 wt % of formic acid). Dried bagasse (comprising 40.7 wt % of glucan, 20.5 wt % of xylan, 2.9 wt % of Arab polysaccharides, 27.4 wt % of lignin, 3.3 wt % of ash and 5.2 wt % of other ingredients) was added to the mixing solution (10 wt % of bagasse) for a dissolution reaction (65° C.). After the dissolution of the bagasse, water was added to the mixing solution (50 wt % of water) and the mixing solution was heated to 100° C. for a hydrolysis reaction. Next, saturated sodium carbonate ($Na_2CO_3$) aqueous solution was added to neutralize the mixing solution. Zinc carbonate ($ZnCO_3$) precipitate was then removed from the mixing solution. Next, the yields of glucose and xylose were analyzed using high performance liquid chromatography (HPLC) and the total weight of the reducing sugar was measured using 3,5-dinitro-salicylic acid (DNS) method. The yield of the reducing sugar was then calculated. The reducing sugar comprised glucose, xylose, mannose, arabinose and oligosaccharides thereof. The yield of the glucose is the ratio of the moles of the produced glucose and the moles of the glucose monomers contained in the cellulose in the bagasse. The yield of the xylose is the ratio of the moles of the produced xylose and the moles of the xylose monomers contained in the hemicellulose in the bagasse. The yield of the reducing sugar is the ratio of the total weight of the reducing sugar and the total weight of the cellulose and hemicellulose in the bagasse. The result is shown in Table 9.

Example 9-2

37 wt % of HCl, iron chloride ($FeCl_3$) and formic acid were mixed by stirring and heated to 55° C. under 1 atm to form a mixing solution (1 wt % of HCl, 2 wt % of iron chloride, 97 wt % of formic acid). Dried bagasse (comprising 40.7 wt % of glucan, 20.5 wt % of xylan, 2.9 wt % of Arab polysaccharides, 27.4 wt % of lignin, 3.3 wt % of ash and 5.2 wt % of other ingredients) was added to the mixing solution (10 wt % of bagasse) for a dissolution reaction (65° C.). After the dissolution of the bagasse, water was added to the mixing solution (50 wt % of water) and the mixing solution was heated to 100° C. for a hydrolysis reaction. Next, saturated sodium carbonate ($Na_2CO_3$) aqueous solution was added to neutralize the mixing solution. Iron carbonate ($Fe_2(CO_3)_3$) precipitate was then removed from the mixing solution. Next, the yields of glucose and xylose were analyzed using high performance liquid chromatography (HPLC) and the total weight of the reducing sugar was measured using 3,5-dinitro-salicylic acid (DNS) method. The yield of the reducing sugar was then calculated. The reducing sugar comprised glucose, xylose, mannose, arabinose and oligosaccharides thereof. The yield of the glucose is the ratio of the moles of the produced glucose and the moles of the glucose monomers contained in the cellulose in the bagasse. The yield of the xylose is the ratio of the moles of the produced xylose and the moles of the xylose monomers contained in the hemicellulose in the bagasse. The yield of the reducing sugar is the ratio of the total weight of the reducing sugar and the total weight of the cellulose and hemicellulose in the bagasse. The result is shown in Table 9.

Example 9-3

98 wt % of $H_2SO_4$, iron chloride ($FeCl_3$) and formic acid were mixed by stirring and heated to 55° C. under 1 atm to form a mixing solution (1 wt % of $H_2SO_4$, 2 wt % of iron chloride, 97 wt % of formic acid). Dried bagasse (comprising 40.7 wt % of glucan, 20.5 wt % of xylan, 2.9 wt % of Arab polysaccharides, 27.4 wt % of lignin, 3.3 wt % of ash and 5.2 wt % of other ingredients) was added to the mixing solution (10 wt % of bagasse) for a dissolution reaction (65° C.). After the dissolution of the bagasse, water was added to the mixing solution (50 wt % of water) and the mixing solution was heated to 100° C. for a hydrolysis reaction. Next, saturated sodium carbonate ($Na_2CO_3$) aqueous solution was added to neutralize the mixing solution. Iron carbonate ($Fe_2(CO_3)_3$) precipitate was then removed from the mixing solution. Next, the yields of glucose and xylose were analyzed using high performance liquid chromatography (HPLC) and the total weight of the reducing sugar was measured using 3,5-dinitro-salicylic acid (DNS) method. The yield of the reducing sugar was then calculated. The reducing sugar comprised glucose, xylose, mannose, arabinose and oligosaccharides thereof. The yield of the glucose is the ratio of the moles of the produced glucose and the moles of the glucose monomers contained in the cellulose in the bagasse. The yield of the xylose is the ratio of the moles of the produced xylose and the moles of the xylose monomers contained in the hemicellulose in the bagasse. The yield of the reducing sugar is the ratio of the total weight of the reducing sugar and the total weight of the cellulose and hemicellulose in the bagasse. The result is shown in Table 9.

TABLE 9

| Examples | Hydrolysis time (min) | Yield of glucose (%) | Yield of xylose (%) | Yield of reducing sugar (%) |
|---|---|---|---|---|
| 9-1 | 90 | 67.5 | 82.7 | 94.5 |
| 9-2 | 90 | 57.5 | 78.3 | 76.6 |
| 9-3 | 90 | 50.5 | 85.3 | 75.1 |

Example 10-1

Formic acid, acetic acid and zinc chloride ($ZnCl_2$) were mixed and heated to form a mixing solution (54 wt % of formic acid, 6 wt % of acetic acid and 40 wt % of zinc chloride). Avicel® cellulose (Sigma Corporation, Avicel-pH-105-27NI) was added to the mixing solution (5 wt % of Avicel® cellulose) for a dissolution reaction (60° C., 60 minutes), forming an amber transparent liquid with an uniform phase. The dissolution of cellulose was observed using a polarizing microscope. The cellulose was completely dissolved.

Example 10-2

Formic acid, acetic acid and calcium chloride ($CaCl_2$) were mixed and heated to form a mixing solution (72 wt % of formic acid, 8 wt % of acetic acid and 20 wt % of calcium chloride). Avicel® cellulose (Sigma Corporation, Avicel-pH-105-27NI) was added to the mixing solution (5 wt % of Avicel® cellulose) for a dissolution reaction (60° C., 180 minutes), forming an amber transparent liquid with an uniform phase. The dissolution of cellulose was observed using a polarizing microscope. The cellulose was completely dissolved.

Example 10-3

Formic acid, acetic acid and zinc chloride ($ZnCl_2$) were mixed and heated to form a mixing solution (50 wt % of formic acid, 10 wt % of acetic acid and 40 wt % of zinc chloride). Avicel® cellulose (Sigma Corporation, Avicel-pH-105-27NI) was added to the mixing solution (5 wt % of Avicel® cellulose) for a dissolution reaction (65° C., 60 minutes), forming an amber transparent liquid with an uniform phase. The dissolution of cellulose was observed using a polarizing microscope. The cellulose was completely dissolved.

Example 10-4

Formic acid, acetic acid and zinc chloride ($ZnCl_2$) were mixed and heated to form a mixing solution (40 wt % of formic acid, 20 wt % of acetic acid and 40 wt % of zinc chloride). Avicel® cellulose (Sigma Corporation, Avicel-pH-105-27NI) was added to the mixing solution (5 wt % of Avicel® cellulose) for a dissolution reaction (65° C., 60 minutes), forming an amber transparent liquid with an uniform phase. The dissolution of cellulose was observed using a polarizing microscope. The cellulose was completely dissolved.

It will be apparent to those skilled in the art that various modifications and variations can be made to the disclosed embodiments. It is intended that the specification and examples be considered as exemplary only, with the true scope of the disclosure being indicated by the following claims and their equivalents.

What is claimed is:

1. A method for fabricating a sugar product, comprising:

mixing an acid compound and zinc chloride, iron chloride, zinc bromide, iron bromide or heteropoly acid to form a mixing solution, wherein the zinc chloride or zinc bromide has a weight ratio of 5-45% and the iron chloride or iron bromide has a weight ratio of 1-50% in the mixing solution, wherein the acid compound comprises formic acid, acetic acid or a mixture thereof;

adding a cellulosic biomass to the mixing solution for a dissolution reaction; and adding water to the mixing solution for a hydrolysis reaction to obtain a sugar product.

2. The method for fabricating a sugar product as claimed in claim 1, wherein the formic acid or acetic acid has a weight ratio of 50-97% in the mixing solution.

3. The method for fabricating a sugar product as claimed in claim 1, wherein the heteropoly acid comprises $H_3PW_{12}O_{40}$, $H_4SiW_{12}O_{40}$, $H_3PMo_{12}O_{40}$ or $H_4SiMo_{12}O_{40}$.

4. The method for fabricating a sugar product as claimed in claim 1, wherein the heteropoly acid has a weight ratio of 1-5% in the mixing solution.

5. The method for fabricating a sugar product as claimed in claim 1, wherein the cellulosic biomass comprises cellulose, hemicellulose or lignin.

6. The method for fabricating a sugar product as claimed in claim 1, wherein the cellulosic biomass is derived from wood, grass, leaves, algae, waste paper, corn stalks, corn cobs, rice straw, rice husk, wheat straw, bagasse, bamboo or crop stems.

7. The method for fabricating a sugar product as claimed in claim 1, wherein the dissolution reaction has a reaction temperature of 40-90° C.

8. The method for fabricating a sugar product as claimed in claim 1, wherein the dissolution reaction has a reaction time of 20-360 minutes.

9. The method for fabricating a sugar product as claimed in claim 1, wherein the amount of water added is larger than the total molar equivalent of monosaccharides hydrolyzed from the cellulosic biomass.

10. The method for fabricating a sugar product as claimed in claim 1, wherein the hydrolysis reaction has a reaction temperature of 50-150° C.

11. The method for fabricating a sugar product as claimed in claim 1, wherein the hydrolysis reaction has a reaction time of 30-180 minutes.

12. The method for fabricating a sugar product as claimed in claim 1, wherein the sugar product comprises a sugar mixture, an acid compound and a salt compound.

13. The method for fabricating a sugar product as claimed in claim 12, wherein the sugar mixture comprises glucose, xylose, mannose, arabinose and oligosaccharides thereof.

14. The method for fabricating a sugar product as claimed in claim 12, wherein the sugar mixture has a weight ratio of 2-15% in the sugar product.

15. The method for fabricating a sugar product as claimed in claim 12, wherein the salt compound comprises zinc chloride, iron chloride, zinc bromide or iron bromide.

16. The method for fabricating a sugar product as claimed in claim 12, wherein the salt compound has a weight ratio of 1-50% in the sugar product.

17. The method for fabricating a sugar product as claimed in claim 1, further comprising adding inorganic acid to the mixing solution.

18. The method for fabricating a sugar product as claimed in claim 17, wherein the inorganic acid comprises sulfuric acid or hydrochloric acid.

19. The method for fabricating a sugar product as claimed in claim 17, wherein the inorganic acid has a weight ratio of 1-2% in the mixing solution.

20. The method for fabricating a sugar product as claimed in claim 17, wherein the zinc chloride, the zinc bromide, the iron chloride or iron bromide has a weight ratio of 1-5% in the mixing solution.

21. A method for fabricating a sugar product, comprising:

mixing formic acid and lithium chloride, magnesium chloride, calcium chloride, lithium bromide, magnesium bromide, calcium bromide or heteropoly acid to form a mixing solution, wherein the lithium chloride or lithium bromide has a weight ratio of 5-20%, the magnesium chloride or magnesium bromide has a weight ratio of 10-30%, and the calcium chloride or calcium bromide has a weight ratio of 12-40% in the mixing solution;

adding a cellulosic biomass to the mixing solution for a dissolution reaction; and adding water to the mixing solution for a hydrolysis reaction to obtain a sugar product.

22. The method for fabricating a sugar product as claimed in claim 21, wherein the formic acid has a weight ratio of 50-97% in the mixing solution.

23. The method for fabricating a sugar product as claimed in claim 21, wherein the heteropoly acid comprises $H_3PW_{12}O_{40}$, $H_4SiW_{12}O_{40}$, $H_3PMo_{12}O_{40}$ or $H_4SiMo_{12}O_{40}$.

24. The method for fabricating a sugar product as claimed in claim 21, wherein the heteropoly acid has a weight ratio of 1-5% in the mixing solution.

25. The method for fabricating a sugar product as claimed in claim 21, wherein the cellulosic biomass comprises cellulose, hemicellulose or lignin.

26. The method for fabricating a sugar product as claimed in claim 21, wherein the cellulosic biomass is derived from wood, grass, leaves, algae, waste paper, corn stalks, corn cobs, rice straw, rice husk, wheat straw, bagasse, bamboo or crop stems.

27. The method for fabricating a sugar product as claimed in claim 21, wherein the dissolution reaction has a reaction temperature of 40-90° C.

28. The method for fabricating a sugar product as claimed in claim 21, wherein the dissolution reaction has a reaction time of 20-360 minutes.

29. The method for fabricating a sugar product as claimed in claim 21, wherein the amount of water added is larger than the total molar equivalent of monosaccharides hydrolyzed from the cellulosic biomass.

30. The method for fabricating a sugar product as claimed in claim 21, wherein the hydrolysis reaction has a reaction temperature of 50-150° C.

31. The method for fabricating a sugar product as claimed in claim 21, wherein the hydrolysis reaction has a reaction time of 30-180 minutes.

32. The method for fabricating a sugar product as claimed in claim 21, wherein the sugar product comprises a sugar mixture, formic acid and a salt compound.

33. The method for fabricating a sugar product as claimed in claim 32, wherein the sugar mixture comprises glucose, xylose, mannose, arabinose and oligosaccharides thereof.

34. The method for fabricating a sugar product as claimed in claim 32, wherein the sugar mixture has a weight ratio of 2-15% in the sugar product.

35. The method for fabricating a sugar product as claimed in claim 32, wherein the salt compound comprises lithium chloride, magnesium chloride, calcium chloride, lithium bromide, magnesium bromide or calcium bromide.

36. The method for fabricating a sugar product as claimed in claim 32, wherein the salt compound has a weight ratio of 1-50% in the sugar product.

37. The method for fabricating a sugar product as claimed in claim 21, further comprising adding inorganic acid to the mixing solution.

38. The method for fabricating a sugar product as claimed in claim 37, wherein the inorganic acid comprises sulfuric acid or hydrochloric acid.

39. The method for fabricating a sugar product as claimed in claim 37, wherein the inorganic acid has a weight ratio of 1-2% in the mixing solution.

40. The method for fabricating a sugar product as claimed in claim 36, wherein the magnesium chloride, the magnesium bromide, the calcium chloride or the calcium bromide has a weight ratio of 1-10% in the mixing solution.

41. The method for fabricating a sugar product as claimed in claim 36, wherein the lithium chloride or lithium bromide has a weight ratio of 1-5% in the mixing solution.

* * * * *